US006055813A

United States Patent [19]

Keller et al.

[11] Patent Number: 6,055,813

[45] Date of Patent: May 2, 2000

[54] PLENUM

[75] Inventors: Jakob Keller, Wohlen; Hugh Jackson, Nussbaumen; Ulf Müller, Kirchdorf; Bettina Paikert, Oberrohrdorf, all of Switzerland; Khawar Syed, St. Albans, United Kingdom

[73] Assignee: Asea Brown Boveri AG, Baden, Switzerland

[21] Appl. No.: 09/141,585

[22] Filed: Aug. 28, 1998

[30] Foreign Application Priority Data

Aug. 30, 1997 [GB] United Kingdom ..... 197 37 997

[51] Int. Cl.[7] ..... F02C 9/16

[52] U.S. Cl. ..... 60/759

[58] Field of Search ..... 60/759, 760

[56] References Cited

U.S. PATENT DOCUMENTS

| | | | |
|---|---|---|---|
| 3,691,766 | 9/1972 | Champion | 60/39.82 P |
| 4,211,069 | 7/1980 | Kalbfuss | 60/39.02 |
| 5,077,969 | 1/1992 | Liang et al. | 60/261 |
| 5,363,644 | 11/1994 | Skekleton et al. | 60/39.36 |
| 5,953,919 | 9/1999 | Meylan | 60/752 |

FOREIGN PATENT DOCUMENTS

| | | |
|---|---|---|
| 0321809B1 | 5/1991 | European Pat. Off. . |
| 0619457A1 | 10/1994 | European Pat. Off. . |
| 0710797A2 | 5/1996 | European Pat. Off. . |
| 2539993 | 3/1976 | Germany . |
| 19523094A1 | 1/1997 | Germany . |
| 54-144510 | 10/1979 | Japan . |

*Primary Examiner*—Charles G. Freay
*Assistant Examiner*—Ehud Gartenberg
*Attorney, Agent, or Firm*—Burns, Doane, Swecker & Mathis, L.L.P.

[57] ABSTRACT

Described is a plenum, in particular the air plenum of a gas-turbine combustion chamber, having at least two flow inlets, for introducing gas flows into the plenum, in which the gas flows are guided essentially along the inner wall of the plenum and are directed toward one another in such a way that the gas flows, after coinciding, are directed as a free gas flow away from the inner wall.

The invention is distinguished by the fact that at least one flow obstacle (11) oriented in interaction with the direction of flow of the gas flows (1, 2) guided on the inner wall (3) is provided on the inner wall (3).

9 Claims, 4 Drawing Sheets

PLENUM

BACKGROUND OF THE INVENTION

1. Field of the Invention

The invention relates to a plenum according to the preamble of the first claim.

2. Discussion of Background

In the design of modern gas-turbine plants, economical and environmental aspects play an increasingly important role. In this connection, with regard to preserving natural resources and in particular while avoiding high emission values, attempts are made to optimize, in their energy-conversion properties, those individual components of a gas-turbine plant in which energy is converted.

In the case of gas-turbine plants, the combustion chamber, in which gas and/or liquid fuel is mixed with precompressed air and made to ignite, forms the heart of the energy conversion. In this case, the combustion of the fuel atomized in air is to be effected as completely as possible, so that all the fuel burns while developing the highest possible temperatures. On the one hand, combustion of the fuel to the fullest possible extent leads to optimum energy conversion, as a result of which the efficiency of the entire gas-turbine plant is substantially determined; on the other hand, the emission gases $NO_x$ and $CO_2$ gases can be considerably reduced at the highest possible combustion temperatures, as a result of which a decisive, positive influence can be exerted on the environmental pollution.

In addition to the optimization of burner arrangements which produce as homogeneous a fuel atomization as possible and thus uniform combustion, it is important, in particular during the operation of modern burner arrangements as described, for example, in European Patent EP 0 321 809 B1, that the compressed air in the plenum of the burner arrangement is free of turbulence as far as possible in an undisturbed air flow and is available in a directed manner. Modern burners, as can be gathered from the publication cited above, have conical contours which provide narrow inlet slots along the outside of their cone, and the air flow required for the mixing of fuel and air has to be injected through these inlet slots.

The problems which are associated with the directing of the flow inside a plenum, into which flow an air flow is to be directed as far as possible free of turbulence in inlet openings of a burner provided in the plenum, are to be shown with reference to FIGS. 1*a* and 1*b*, which represent the prior art.

FIG. 1*a* shows a casing G into which gas flows 1, 2 are blown via inlet openings 4, 5. The velocity on a statistical average disappears at an impingement point A of the two gas flows 1, 2, called partial streams below. In addition, the limit flow lines of the two partial streams 1, 2 which pass through the impingement point A attain the same static pressure at this location. For these reasons, the total pressure on both limit flow lines must be the same. As a rule, the two partial streams 1, 2 experience different friction losses on their way from the compressor diffuser through the cooling system of the combustion chamber up to the air dome/plenum of the combustion chamber, since the entry velocities into the plenum 6 of the combustion chamber are not exactly the same. For this reason, the partial streams 1, 2 have different total pressures. Due to the total-pressure difference of the two partial streams 1, 2, the impingement point A of the two partial streams is forcibly displaced (as shown in FIG. 1*b*) into the immediate vicinity of the inlet opening of the partial stream having the smaller total pressure.

On account of the above-described flow properties which are inherent in a plurality of gas flows introduced into the interior of a casing for their mutual mixing or combining, the air supply, shown in FIG. 1*b* in the ideal case, to a burner 9 which is arranged inside a plenum 6 is greatly impaired.

The plenum 6 is surrounded by a casing wall G and has on the left-hand side two inlet openings 4, 5 for two gas flows 1, 2, which are directed along the casing inner wall 3 into the interior of the plenum 6. The gas flows 1, 2 coincide in a region which is located around the impingement point A and from which a common, free gas flow 7 into the interior of the plenum 6 develops. In the ideal case, the common, free gas flow 7 should enter a gap-like inlet opening 8 of the burner 9 and be mixed there with gaseous and/or liquid fuel and be made to ignite in a combustion chamber 15.

On account of the above flow effects, however, the common, free gas flow does not develop into an undisturbed, uniform flow, but is subjected to an unsteady lateral movement relative to the inlet opening 8 of the burner and in addition has very pronounced, turbulent flow portions. However, this generally leads to considerable impairment of the aerodynamic properties of the burner 9, which not least have an effect on poor combustion, as a result of which the emission values of the burner are made much worse. Likewise, flashback effects may occur in combination with turbulence effects inside the burner, which are initiated by the common, entering gas flow 7, and these flashback effects may lead to the extinction of the combustion flame or to overheating.

SUMMARY OF THE INVENTION

Accordingly, one object of the invention is to develop a novel plenum, in particular the air-feed plenum of a gas-turbine combustion chamber, having at least two flow inlets, for introducing gas flows into the plenum, in which the gas flows are guided essentially along the inner wall of the plenum and are directed toward one another in such a way that the gas flows, after coinciding, are directed as a free gas flow away from the inner wall, in such a way that, without a high design and production cost, the free gas flow which forms can develop as homogeneously as possible, so that the supply of the burner with intake air can be effected in a manner which does justice to the combustion operation in light of the abovementioned preservation of resources and reduction of the exhaust-gas values. The measures to be taken are also to be capable of being applied subsequently in plants which are already in operation.

The achievement of this object is specified in claims 1 and 7. Features advantageously developing the idea behind the invention are the subject matter of the subclaims.

According to the invention, a plenum according to the preamble of claim 1 is developed in such a way that at least one flow obstacle oriented essentially orthogonally to the direction of flow of the gas flows guided on the inner wall is provided on the inner wall.

The flow obstacle is preferably formed from a plurality of rib lines which are raised orthogonally from the inner wall and whose width and height are approximately of the same dimensions. The flow obstacle is to separate the gas flow from the inner wall, with which said gas flow is in contact, so that the relevant influence exerted by the wall on the gas flow is reduced.

Furthermore, the obstacle opposing the gas flow is to extract kinematic flow energy. Tests have shown that air flows entering the plenum, at velocities of flow of about 70 m/s, can cause very severe burner malfunctions, which are conditioned by the influence exerted by the walls on which the gas flows are guided. If the velocities of flow are reduced to velocity values of less than 20 m/s, the malfunctions decrease to a marked degree, so that the air flows directed into the plenum can largely be brought together to form uniform, free flows. An effective means of reducing the kinetic energy of the gas flows can be achieved with the flow obstacles according to the invention.

A further means of reducing the kinetic flow energy of the gas flows flowing into a plenum to the abovementioned velocity of less than 20 m/s can be achieved by the inlet-opening regions at which the gas flows enter the interior of the plenum being shaped according to the invention.

According to the invention, a plenum according to the preamble of claim 1 is to be developed in such a way that the inner wall in regions of the flow inlets is designed like a step which widens the periphery of the inner wall and has the step height b, and that a guide web of length l limiting the gas flow entering the plenum is provided opposite the step toward the casing interior.

Such a modification of the inlet region of gas flows into the plenum likewise leads to a reduction in the turbulence effects inside the plenum but involves a higher design and technical cost.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1A:
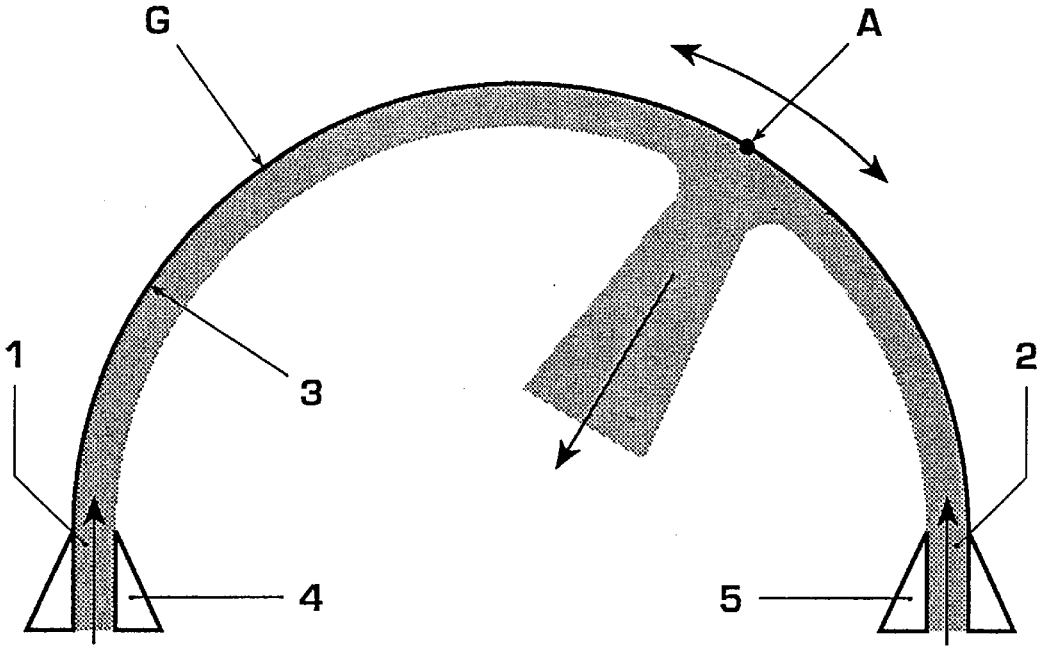
FIG. 1(a) PRIOR ART
FIG. 1*a* shows a diagrammatic sketch for illustrating the expansion behavior of two gas flows guided in a casing.
Figure 1B:
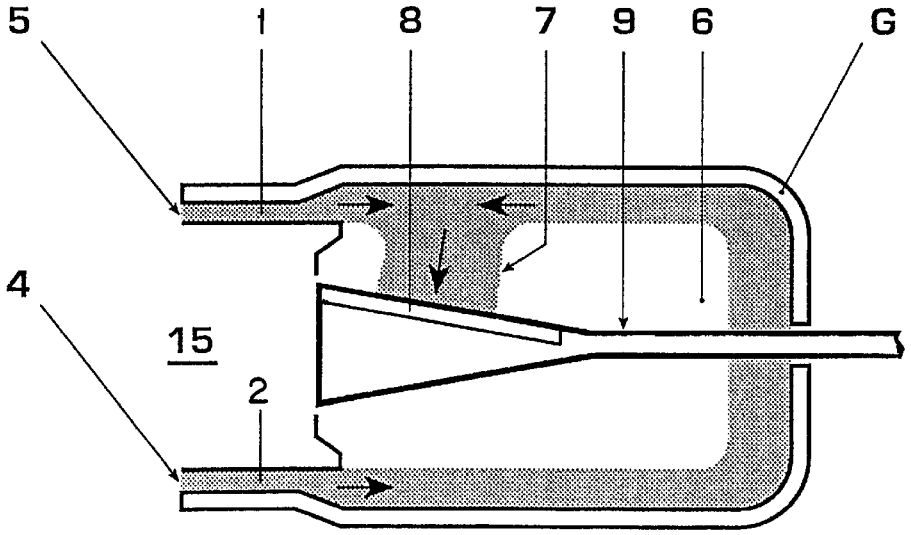
FIG. 1(b) PRIOR ART
FIG. 1*b* shows a cross-sectional representation through a plenum having ideal flow conditions.
Figure 2:
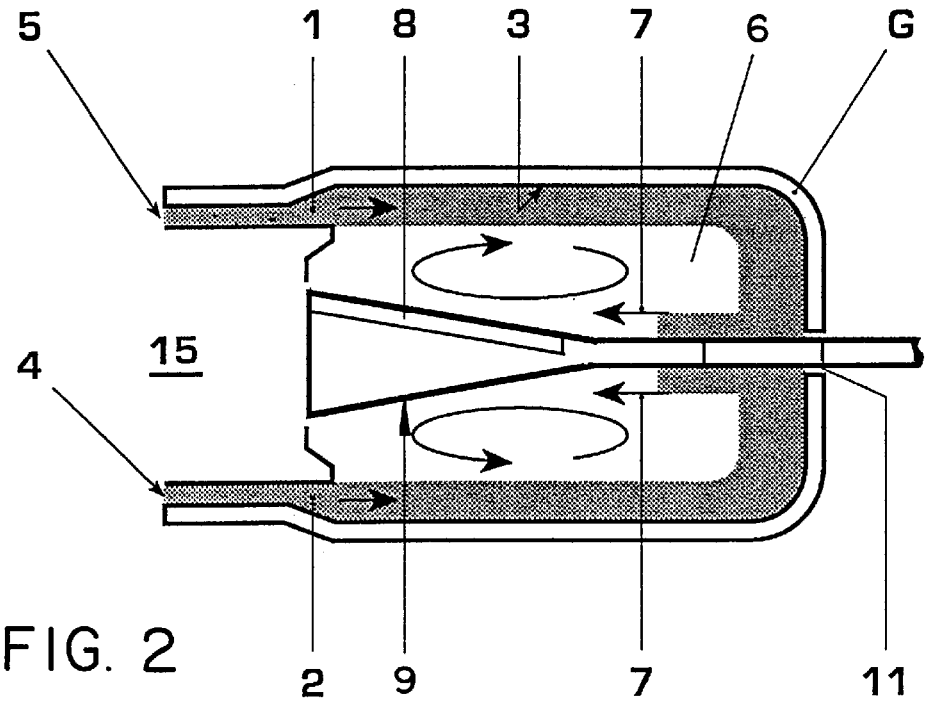
FIG. 2 shows a cross section through an embodiment according to the invention having a flow obstacle.

Referring now to the drawings, wherein like reference numerals designate identical or corresponding parts throughout the several views, two separate gas flows 1 and 2, in the exemplary embodiment shown in FIG. 2, pass through the inlet openings 4 and 5 into the interior of a plenum 6. The gas flows 1 and 2 are each guided on the casing inner wall 3. According to the invention, in order to reduce the flow velocity of the expanding gas flows 1, 2 and to reduce the influence exerted by the wall G on the respective gas flows, a rib 11 is provided orthogonally relative to the direction of flow and to the casing inner wall 3. The flow portions striking the rib 11 are deflected as free gas flows 7 essentially perpendicularly to the casing inner wall 3 into the interior of the plenum 6 in the direction of the burner 9. The burner 9 has at least one gap-like inlet opening 8 through which the free gas flows 7 can enter the interior of the burner 9. It may be pointed out, only for the sake of the better understanding of the representation in FIG. 2, that liquid and/or gaseous fuel is directed into the burner 9 from the right and is mixed with the intake air inside the widening, conical burner section.

The plenum 6 has only a single rib 11, to which the two gas flows 1 and 2 are admitted symmetrically on both sides. Uncontrolled inflow of intake air into the burner can be avoided with this simple rib oriented orthogonally to the direction of flow. As shown in the figure by means of arrows, homogeneous flow circuits develop, which continuously supply the burner with intake air through the inlet opening 8. Although a great deal of flow energy still remains in the gas flows with this measure, the symmetrical admission of the gas flows to the obstacle on both sides leads to controlled circulations inside the plenum.

Figure 3:
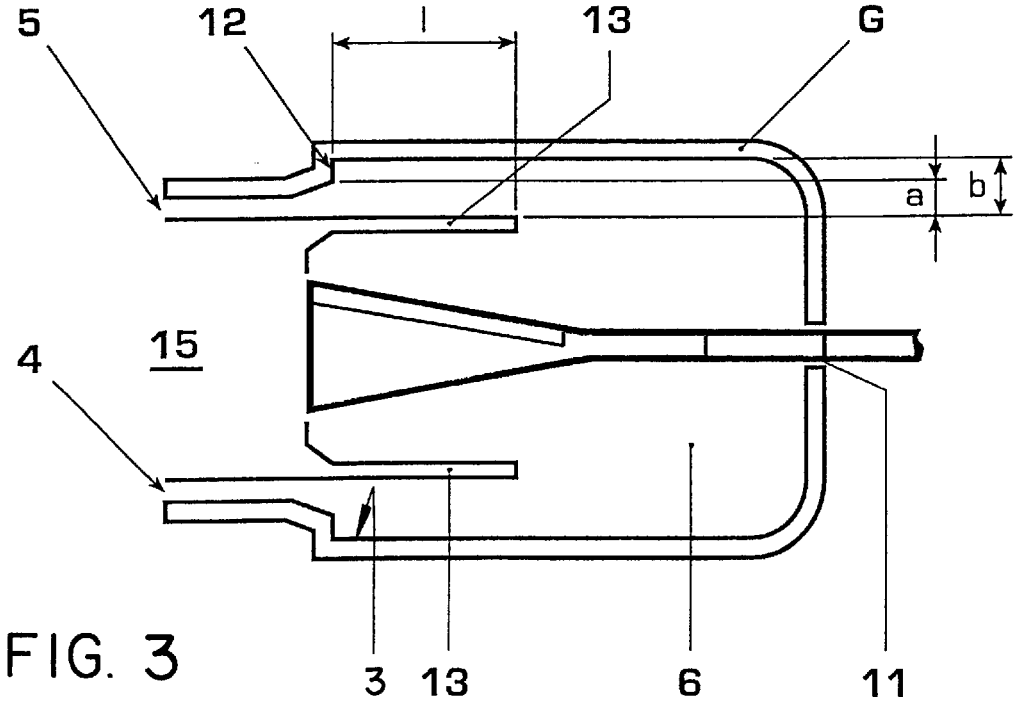
FIG. 3 shows a cross section through an embodiment according to the invention having modified flow-inlet regions.

A further embodiment according to the invention for the controlled inflow of gas flows into a plenum 6 is provided in FIG. 3. In the region of the flow inlets 4 and 5 having a flow cross section a, the inner wall 3 is in each case designed with a step 12 which increases the cross section and has a flow cross section b. A guide web 13 of length l is provided opposite the step 12. By means of the inlet contour formed in FIG. 3, the velocity of flow can be effectively reduced to values of less than 20 m/s. The following dimensions are to be provided for this purpose: $b/a \sim 2$ and $l/b \leqq 3$.

Figure 4A:
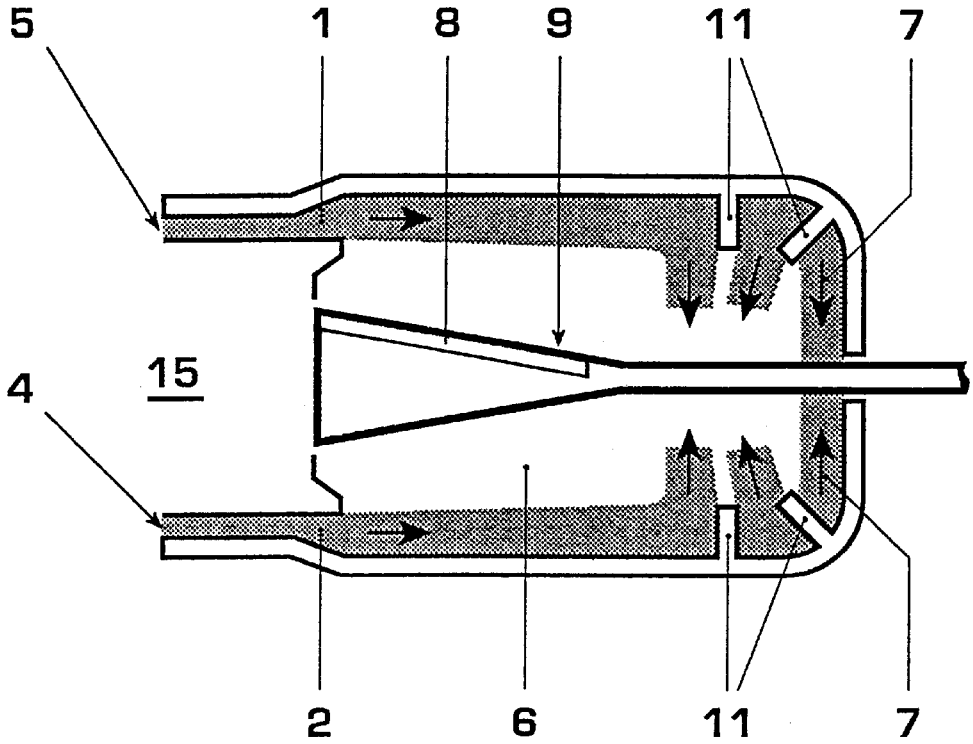
FIG. 4*a* shows a cross section through a plenum designed according to the invention and having flow obstacles.
Figure 4B:
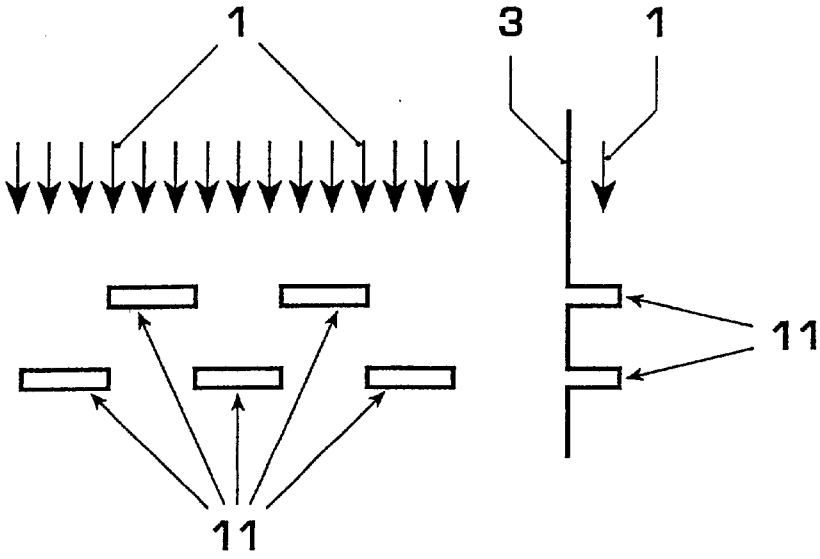
FIG. 4*b* shows a plan view and side view of a staggered arrangement of flow obstacles.

In FIG. 4*b*, an advantageous arrangement of the flow obstacles is shown in the form of individual ribs 11 which resemble, so to speak, the arrangement of an "avalanche brake" known per se. The left-hand arrangement shown in FIG. 4*b* shows individual ribs 11 in plan view, from which it can be seen that the ribs 11 are staggered one behind the other, so that they constitute a complete obstacle to the gas flow (see arrows) striking them perpendicularly. An arrangement as shown in FIG. 4*b* leads to a very efficient reduction in the velocity of flow as well as to a separation of the flow from the container inner wall. Ribs whose height and width are approximately of the same dimensions are especially suitable. The side view of the rib arrangement shown in FIG. 4*a* is shown in the right-hand representation according to FIG. 4*b*.

If only a single line of ribs which opposes the gas flow over a complete longitudinal extent is used, it has been found that the gas flow merely flows over the rib obstacle and adheres to the container wall again on the side remote from the flow. This phenomenon is also designated as Coanda effect.

The arrangement shown in FIG. 4*b* of individual flow obstacles, the individual lengths of which are not much larger than their heights, is able to effectively suppress the abovementioned Coanda effect, so that the gas flow which has passed a line of ribs is no longer in contact with the container inner wall. The flat-spread shape of flow along the container inner wall is interrupted by the flow obstacles designed according to the invention, as a result of which an identical static pressure appears on both sides of the flow obstacle in the gas flow.

Due to the measure according to the invention of providing lines of ribs arranged like an avalanche shelter along the container inner wall, the gas flows can be decelerated to a decisive extent and channeled into a free, homogeneous gas flow 7. Better, more uniform supply of the burner with intake air is possible in this way.

Figure 5:
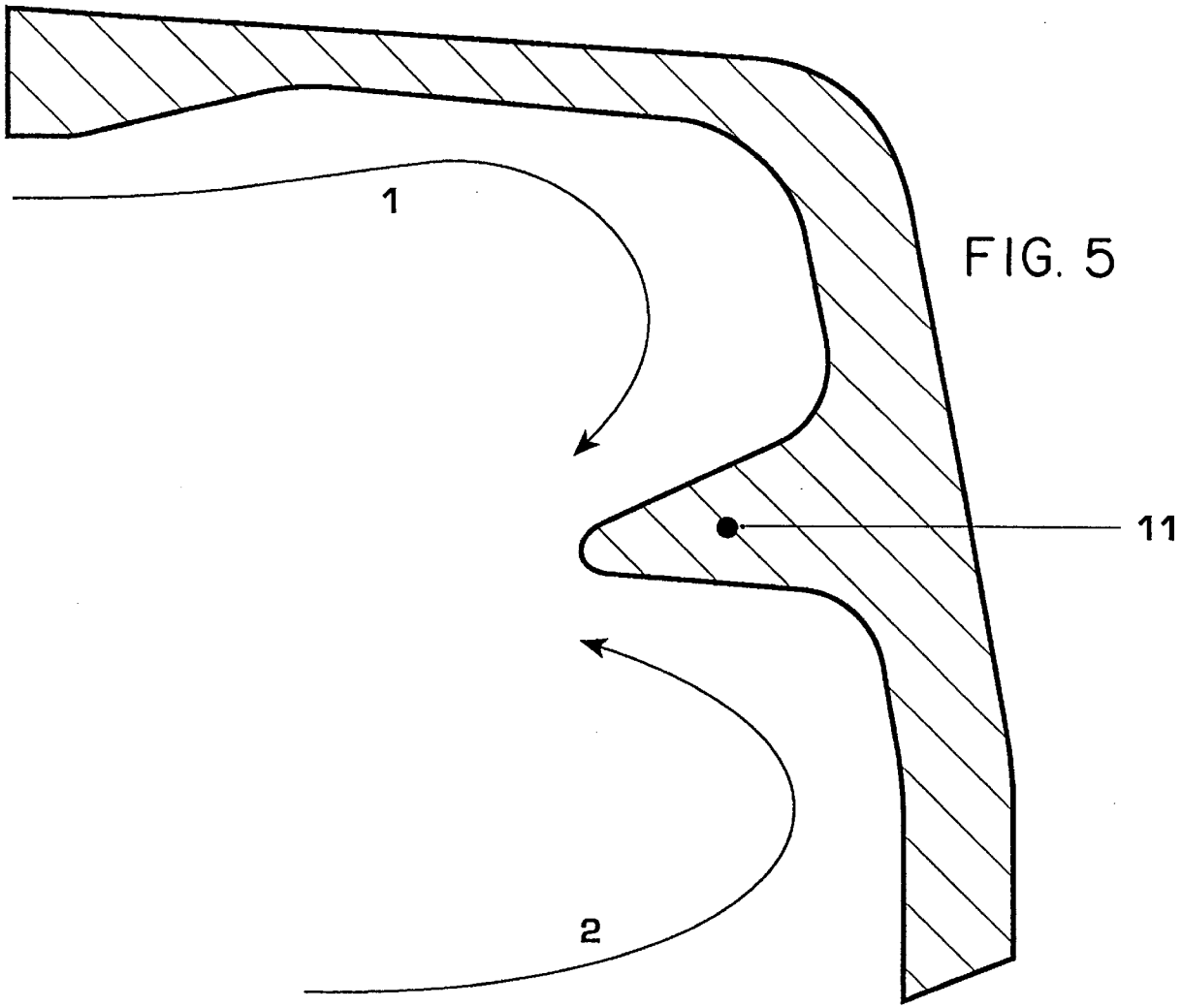
FIG. 5 shows a cross section through a plenum developed according to the invention.

FIG. 5 shows the basic flow profile of two gas flows 1 and 2 which are accordingly deflected at a rib 11. The cross-sectional representation according to FIG. 5 corresponds to a section through the plenum of an annular combustion chamber (not shown). However, a rib which is configured in this way may also be arranged in the case of any other plenums.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A plenum of a gas-turbine combustion chamber, incorporating at least two flow inlets through which gas is entering the plenum, in such a manner that the resulting at least two gas flows are led along the plenum inner wall such that the gas flows meet each other and subsequently form a jet directed towards the centre of the plenum, wherein at least one flow obstacle having a continuous closed outer surface is provided on the inner side of the plenum outer wall, which said obstacle is interacting with the gas flows led along the plenum inner wall.

2. The plenum as claimed in claim 1, wherein the flow obstacle is oriented essentially orthogonally to the direction of flow of the gas flows guided on the inner wall.

3. The plenum as claimed in claim 1, wherein at least one flow obstacle is provided for each gas flow.

4. The plenum as claimed in claim 1 wherein the flow obstacle is a rib which is raised orthogonally from the inner wall and whose width and height are approximately the same.

5. The plenum as claimed in claim 3, wherein the ribs on the inner wall are arranged alternately one behind the other in at least two rows in the direction of flow of the gas flow in such a way that the ribs are next to one another in the flow direction.

6. The plenum as claimed in claim 1, wherein a burner is arranged in the plenum, which burner has an inlet opening into which the jet can be directed.

7. The plenum as claimed in claim 1, wherein the inner wall in the region of the flow inlet is provided with means for reducing the velocity of the entering gas flow.

8. The plenum as claimed in claim 7, wherein the inner wall in the regions of the flow inlets is designed like a step which widens the periphery of the inner wall.

9. The plenum as claimed in claim 8, wherein a guide web limiting the gas flow entering the plenum is provided opposite the step toward the casing interior.

* * * * *

UNITED STATES PATENT AND TRADEMARK OFFICE

CERTIFICATE OF CORRECTION

PATENT NO. : 6,055,813
DATED : May 2, 2000
INVENTOR(S) : Jakob KELLER; Hugh JACKSON, Ulf MÜLLER; Bettina PAIKERT and Khawar SYED It is certified that error appears in the above-identified patent and that said Letters Patent is hereby corrected as shown below:

On the title page item [54], and column 1, line 1, delete 'PLENUM" and insert therefor -- COMBUSTOR PLENUM HAVING FLOW MANIPULATORS --.

Signed and Sealed this

Twentieth Day of February, 2001

*Attest:*

Nicholas P. Godici

NICHOLAS P. GODICI

*Attesting Officer*

*Acting Director of the United States Patent and Trademark Office*